United States Patent [19]

Oyama et al.

[11] 4,094,285

[45] June 13, 1978

[54] GAS MIXTURE FEED SYSTEM FOR INTERNAL COMBUSTION ENGINE

[75] Inventors: Yoshishige Oyama, Katsuta; Takao Teranishi, Hitachi; Teruo Yamauchi, Katsuta, all of Japan

[73] Assignee: Hitachi, Ltd., Japan

[21] Appl. No.: 712,089

[22] Filed: Aug. 5, 1976

[30] Foreign Application Priority Data

Aug. 8, 1975 Japan ..... 50-95809

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 1,338,104 | 4/1920 | Shurtleff | 123/119 A |
| 1,362,394 | 12/1920 | Church | 123/119 A |
| 3,981,284 | 9/1976 | Gospodar | 123/119 A |

FOREIGN PATENT DOCUMENTS

| | | | |
|---|---|---|---|
| 323,642 | 1/1930 | United Kingdom | 123/119 A |

*Primary Examiner*—Wendell E. Burns
*Attorney, Agent, or Firm*—Craig & Antonelli

[57] ABSTRACT

A gas mixture feed system provided therein with an exhaust gas recirculating passageway. The gas mixture feed system comprises: a throttle valve; a movable vane operationally associated with the throttle valve to regulate Venturi negative pressure; a variable stage type carburetor provided therein with a fuel metering device controlled by the movable vane; and an exhaust gas recirculating passageway for recirculating part of the exhaust gas of the internal combustion engine to the carburetor. The exhaust gas recirculating passageway has an opening within an intake passageway disposed between the movable vane of the carburetor and the throttle valve, whereby intake air and recirculating exhaust gas are uniformly mixed. Mounted in the exhaust gas recirculating passageway is a control valve which is mechanically connected to the movable vane so as to change the area of opening in accordance with the movement of the movable vane.

11 Claims, 9 Drawing Figures

GAS MIXTURE FEED SYSTEM FOR INTERNAL COMBUSTION ENGINE

BACKGROUND OF THE INVENTION

This invention relates to a gas mixture feed system of an internal combustion engine, and more particularly to a gas mixture feed system provided therein with an exhaust gas recirculating device suitable for use in decreasing the quantities of nitrogen oxide and the like.

Heretofore there has been used an exhaust gas recirculating device adapted to introduce part of exhaust gas to an intake pipe for decreasing the quantity of nitrogen oxide contained in the exhaust gas of the internal combustion engine. It is well known that, if the ratio between the quantity of recirculated exhaust gas and the quantity of air intake is termed as an exhaust gas recirculation rate, then the quantity of nitrogen oxide discharged is decreased with the increase of the exhaust gas recirculation rate. However, if the exhaust gas recirculation rate is increased, then combustion becomes unstable and the quantities of carbon monoxide and hydrocarbon are increased. Consequently, in order to decrease the quantities of nitrogen oxide without causing carbon monoxide and hydrocarbon to be increased in quantities, it is necessary to control the exhaust gas recirculation rate within a narrow range as shown by hatching in FIG. 1.

The conventional exhaust gas recirculating device for the internal combustion engine is of such an arrangement that part of exhaust gas is recirculated to the portion of intake pipe, which is disposed downstream of the throttle valve of the carburetor. For this, the air-fuel mixture and the exhaust gas recirculated are mixed not uniformly in the intake pipe, considerable differences are found between the exhaust gas recirculation rates of the respective cylinders in the case of a multi-cylinder engine as shown in FIG. 2, and difficulties have been felt in accurately controlling the exhaust gas recirculation rates. Further, since the negative pressure downstream of the throttle valve varies to a considerable extent in accordance with the operating conditions of the engine, the quantity of exhaust gas recirculated also varies to a considerable extent, and the exhaust gas recirculation rate varies on the whole. There has been a practice to provide a control valve in the exhaust gas recirculating passageway in order to prevent the variation in said exhaust gas recirculation rate. Said conventional control valve is of the type having a diaphragm to be driven in accordance with the Venturi negative pressure in the carburetor. With said control valve, there is such a shortcoming that accuracy in controlling of the exhaust gas recirculation rate is decreased at the time of operating conditions of low Venturi negative pressure, i.e., at low speed and low load.

SUMMARY OF THE INVENTION

One object of the present invention is to provide a gas mixture feed system for an internal combustion engine for feeding gas mixtures having a uniform exhaust gas recirculation rate to the respective cylinders in a multi-cylinder engine.

Another object of the present invention is to provide a gas mixture feed system for an internal combustion engine capable of accurately controlling the exhaust gas recirculation rate throughout the operating conditions ranging from low speed and low load operation to high speed operation.

A further object of the present invention is to provide a gas mixture feed system for an internal combustion engine which does not effect exhaust gas recirculation at the time of idle running and at the time of full throttle operation, but effects exhaust gas circulation only in between the times of idle running and full throttle operation.

A still further object of the present invention is to provide a gas mixture feed system for an internal combustion engine capable of feeding a rich gas mixture to the engine during exhaust gas recirculation and a lean gas mixture to the engine during the time when exhaust gas is not recirculated.

A yet further object of the present invention is to provide a gas mixture feed system for an internal combustion engine capable of preventing the fuel from being attached to the wall surface of an intake passageway in a carburetor.

Other features and advantages of the invention will hereinafter be made evident in conjunction with the description illustrated in the accompanying drawings.

DETAILED DESCRIPTION OF THE PREFERRED EMBODIMENT

Figure 3:
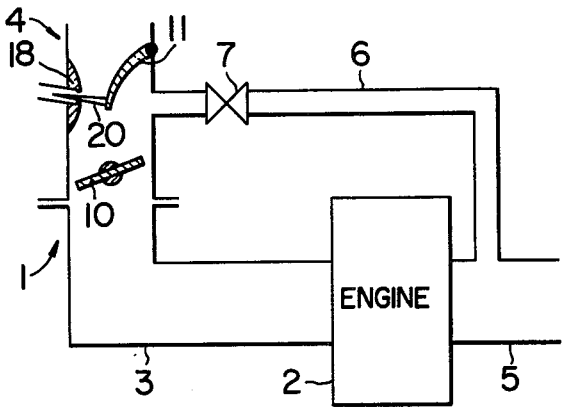
FIG. 3 is a schematic view showing one embodiment of the present invention.

FIG. 3 is a schematic view of one embodiment of the present invention. Designated at reference numeral 1 generally is a gas mixture feed system which comprises an intake pipe 3 connected to an engine 2, a carburetor 4 connected to the intake pipe 3, an exhaust gas recirculating pipe 6 diverging from an exhaust pipe 5 connected to the engine 2 and leading to the carburetor 4, and a control valve 7 for controlling the quantity of exhaust gas recirculated. The carburetor 4 and the control valve 7 are detailedly shown in FIG. 4.

Figure 4:
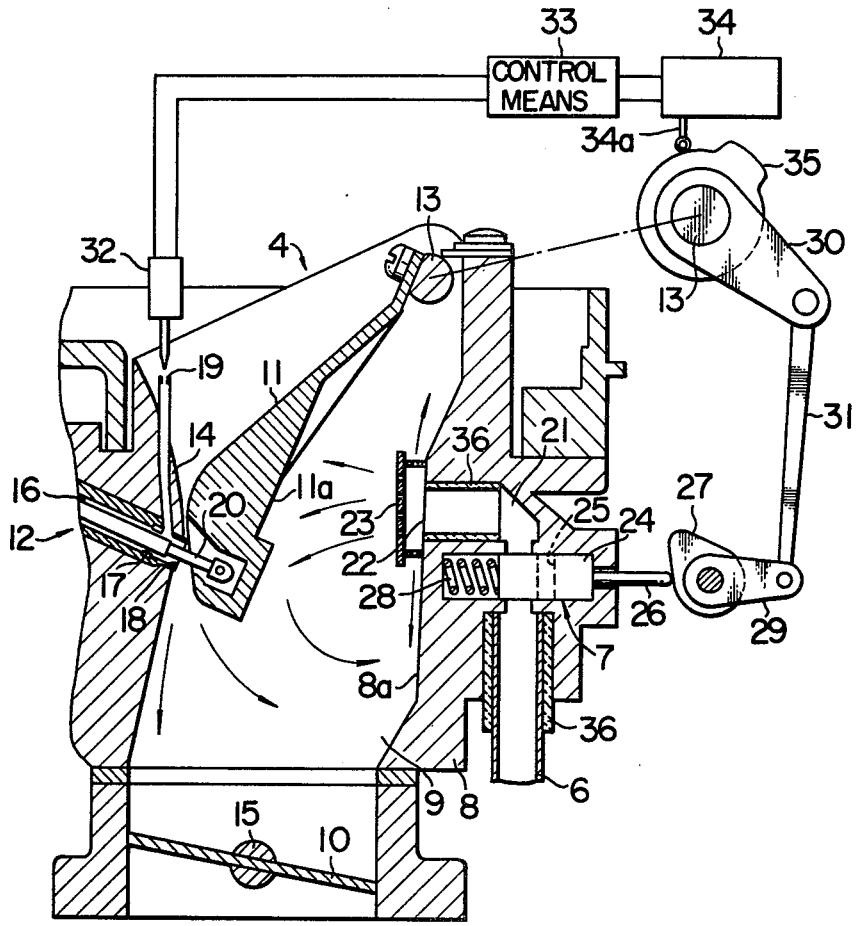
FIG. 4 is a cross-sectional view showing the carburetor used in the embodiment illustrated in FIG. 3.

Referring to FIG. 4, the carburetor 4 is a variable stage type carburetor comprising a main body 8 of carburetor, an intake passageway 9, a throttle valve 10 provided in the intake passageway 9, an air valve or movable vane 11 provided at a portion upstream of the throttle valve 10 and a fuel metering device 12. The movable vane 11 is solidly secured at one end thereof to a vane shaft 13, and rotated together with the vane shaft 13, thereby changing the opening area defined by the movable vane 11 and a fixed Venturi wall 14 formed on the inner wall of the intake passageway 9. The vane shaft 13 is adapted to move together with the throttle valve 10 by being connected to a throttle valve shaft of the throttle valve 10 through a link mechanism (not shown). The fuel metering device 12 is formed in the main body 8 of carburetor and comprises a fuel passageway 16 communicated with a fuel supply source or float chamber (not shown), a metering orifice 17 provided in the fuel passageway 16, a nozzle 18 having an opening within the intake passageway 9, an air bleeder 19 communicated with the fuel passageway between the orifice 17 and the nozzle 18 and also communicated with the intake passageway 9, and a jet needle 20 extending into the nozzle 18 and the orifice 17 and mounted at one end thereof on the forward end of the movable vane 11. The variable stage type carburetor described above has been known in the art, so that the detailed description thereof is omitted.

One feature of the present invention resides in that the main body 8 of carburetor is provided therein with an exhaust gas passageway 21 communicated with the exhaust gas recirculating pipe 6 and the outlet opening 22 of the exhaust passageway 21 is disposed between the movable vane 11 of the intake passageway 9 and the throttle valve 10. The outlet opening 22 is formed in an wall surface **8*a* confronting the rear surface 11*a* of the movable vane 11. Mounted in the vicinity of the outlet opening 22 is a recirculated exhaust gas distributing member 23. Said distributing member 23 is adapted to guide part of recirculated exhaust gas to the rear surface of the movable vane 11, particularly to the vinicity of a connecting portion of the needle 20, and cause another part to flow along the wall surface 8*a* around the outlet opening 22**.

The control valve 7 is provided at the intermediate portion of the exhaust gas passageway 21 formed in the main body 8 of carburetor. Said control valve 7 has a plunger 24 movable perpendicularly to the exhaust gas passageway 21. The plunger 24 is formed therein with a through hole 25 parallel with the exhaust gas passageway 21. Consequently, the opening area of the control valve 7 is varied in accordance with the displacement of the plunger 24 relative to the exhaust gas passagewy 21. The plunger 24 is provided at one end thereof with a rod 26 projecting to the outside of the main body 8 of carburetor, and the tip end of the rod 26 is engaged with a cam 27. The plunger 24 is provided at the other end thereof with a spring 28, whereby the rod 26 is biased to constantly contact the cam 27.

Figure 5:
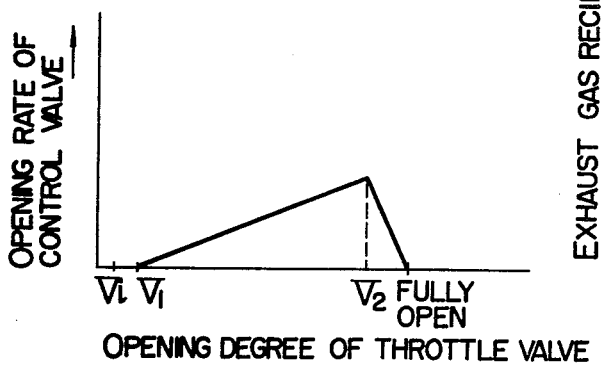
FIG. 5 is a graph showing the relationship between the opening area of control valve and the opening degree of the throttle valve.

The cam 27 is connected to a lever 29 to be rotated together therewith. The lever 29 is connected through a link 31 to a lever 30 solidly secured to the vane shaft 13. Consequently, if the vane shaft 13 is rotated in accordance with the movement of the throttle valve 10, then the cam 27 is rotated simultaneously and the plunger 24 is slided in the axial direction thereof, thus varying the opening area of the control valve 7. The relationship between the opening degree of the throttle valve 10 and the opening area of the control valve 7 can be determined through freely selecting the configuration of the cam 27, the lengths of the levers 29, 30, the contour of cross-section of the portion of the exhaust gas passageway 21 adjacent the plunger, the contour of cross-section of the through-hole 25 and the like. FIG. 5 shows a suitable example of the relationship between the opening degree of the throttle valve 10 and the opening area of the control valve 7. In this example, at the time when the throttle valve 10 is positioned at the idle opening degre $Vi$ corresponding to idle running of the engine, the control valve 7 is fully closed. At the time when the throttle valve is positioned between the opening degree $V_1$ slightly larger than the idle opening $Vi$ and the opening degree $V_2$ in the vicinity of the full opening degree, the opening area of the control valve is substantially proportional to the opening degree of the throttle valve. At the time when the throttle valve 10 is positioned between the opening degree $V_2$ and the full opening degree, the opening area of the control valve 7 is decreased, and when the throttle valve is fully open, the control valve 7 is fully closed. This is because the quantity of exhaust gas proportional to the quantity of air intake is recirculated between the opening degrees $V_1$ and $V_2$ of throttle valve, the recirculation of exhaust gas is interrupted at the time of idle running and the full opening degree of the throttle valve.

Referring to FIG. 4 again, the air bleeder 19 is provided at the forward opening thereof with an air bleed regulating valve 32. Said regulating valve 32 is adapted to be switched "ON" or "OFF" to open or close the air bleeder, and controlled by control means 33. Connected to the control means 33 is a micro-switch 34 whose working arm **34*a* is engaged with a cam 35 solidly second to the vane shaft 13. The configuration of the cam 35 is determined such that at the time of the opening degree of throttle valve being at $V_1$ the regulating valve 32 is energized to close the air bleeder 19, and at the time of the opening degree of throttle valve being fully open, the regulating valve 32 is deenergized to open the air bleeder 19**.

A heat insulating material 36 is mounted on the exhaust gas passageway 21, thus preventing the heat of exhaust gas from being conducted to the main body 8 of carburetor.

Figure 1:
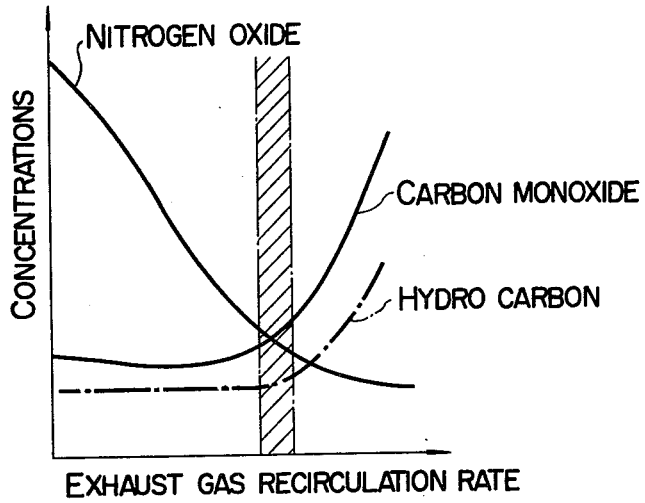
FIG. 1 is a graph showing the concentrations of nitrogen, carbon monoxide and hydrocarbon in the exhaust gas as against the exhaust gas recirculation rate.
Figure 2:
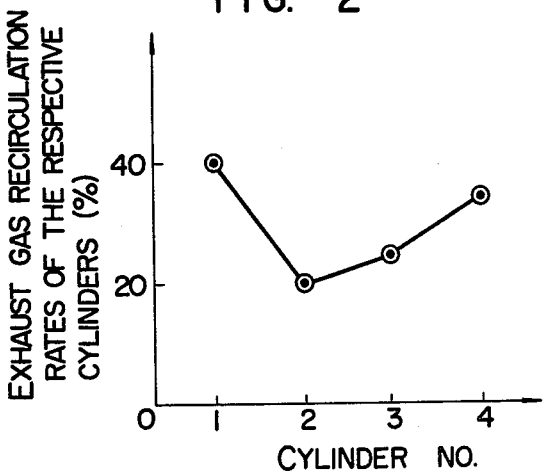
FIG. 2 is a graph showing an example of exhaust gas recirculation rates of gas mixtures fed to the respective cylinders of a multi-cylinder engine, with the conventional system.
Figure 6:
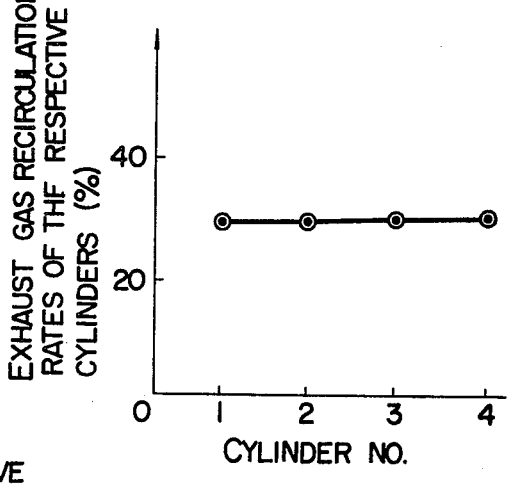
FIG. 6 is a graph showing the exhaust gas recirculation rates in the respective cylinders of the multi-cylinder engine in the embodiment illustrated in FIG. 3 and FIG. 4.

Description will hereunder be given of the operation. Air sucked into the intake passageway of the carburetor 4 passes through a space formed between the movable vane 11 and the fixed Venturi wall 14, and is mixed with fuel to be formed into a gas mixture. The gas mixture is fed to the engine 2 through the air intake pipe 3. On the other hand, part of exhaust gas passes through the exhaust gas recirculating pipe 6 and the control valve 7, and is fed to the air intake passageway of the carburetor 4 between the movable vane 11 and the throttle valve 10. Since a high speed stream of gas mixture having passed the space between the movable vane 11 and the fixed Venturi wall 14 and a stream of exhaust gas enter the intake passageway between the movable vane 11 and the throttle valve 10, swirls are formed in this portion, thus mixing the gas mixture with the exhaust gas. Moreover, the flow thus mixed is further mixed as it passes through the throttle valve 10 to be formed into a very uniform gas mixture and is sucked into the engine 2. According to the results of experiments, as shown in FIG. 6, the exhaust gas recirculation rates of the respective cylinders each show a substantially constant value, and it was found that the variations between the exhaust gas recirculation rates of the respective cylinders can be decreased to a considerable extent as compared with the case that the exhaust gas recirculation is effected to the portion downstream of the throttle valve 7 as shown in FIG. 2.

communication with the air passageway 44 which in turn is communicated with an intake pipe (not shown) upstream of the carburetor, and further, communicated with a passageway 45 through a passageway formed between the valve seat 41 and the tapered surface 39*b*. The passageway 45 has an opening between the movable vane of the intake passageway of carburetor and the throttle valve as in the case of the passageway 43. The valve body 39 carries a rod 46 whose one end is projecting to the outside of the main body of carburetor to be engaged with a cam 47. The cam 47 is connected to a vane shaft so as to be rotated by the vane shaft as in the embodiment shown in FIG. 4. On the other hand, mounted at the other end of the rod 46 is a disk member 48 which functions as valve body to open or close the air passageway 44 and at the same time supports one end of a spring 49. Further, mounted on the rod 46 is a valve body 50 to open or close the passageway 42.

Figure 9:
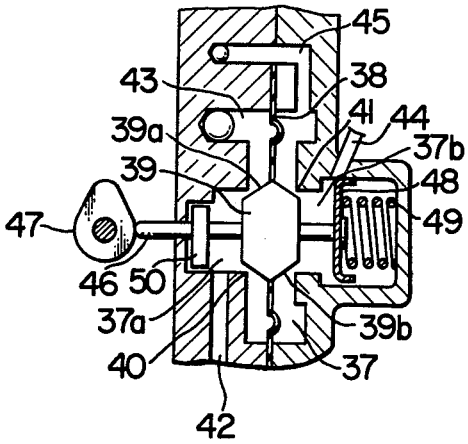
FIG. 9 is a cross-sectional view showing a version of an embodiment of a control valve for controlling the quantity of exhaust gas recirculated.

In the system shown in FIG. 9, in the case that the throttle valve is positioned at the opening degree of idle running, the tapered surface 39*a* of the valve body 39 is engaged with the valve body 40, and consequently, the recirculation of exhaust gas is not effected. On the other hand, the air passageway is slightly open, and hence air is fed to the space formed between the movable vane of the intake passageway of carburetor and the throttle valve. Next, as the throttle valve is opened, the cam 47 is rotated clockwise according to the movement of the throttle valve, to thereby move the rod 46 to the right. For this, the tapered surface 39*a* of the valve body 39 is separated from the valve seat 40, and the exhaust gas is sent from the passageway 42 to the carburetor through the passageway 43. At this time, the tapered surface 39*b* of the valve body 39 is separated from the valve seat 41 and hence air is sent to the carburetor through the passageway 45. As the throttle valve is opened, the sectional area of the space formed between the tapered surface 39*a* and the valve seat 40 is increased whereby the quantity of exhaust gas recirculated is increased in proportion to the quantity of air intake. On the other hand, the quantity of air passing through the passageway 45 is decreased as the throttle valve is opened. In this system, air is sent downwardly of the movable vane through the passageway 45 even at the time of idle running where the recirculation of exhaust gas is not effected. Consequently, the negative pressure downwardly of the movable vane can be prevented from becoming excessively high at the time when the recirculation of exhaust gas is not effected.

It should be understood, however, that there is no intention to limit the invention to the specific form of variable stage type carburetor disclosed in the embodiment, but, the invention is applicable to the type of carburetor in which an air valve provided at a Venturi portion of carburetor is adapted to move in accordance with Venturi negative pressure.

What is claimed is:

1. A gas mixture feed system for an internal combustion engine wherein said gas mixture feed system comprises:

a carburetor including an intake passageway; a throttle valve in said intake passageway, a movable air valve in the intake passageway upstream of said throttle valve, fuel jet means adjacent said air valve for supplying fuel into fresh air passing thereby, and fuel metering means between a fuel supply source and said fuel jet means and controlled by said air valve;

intake passageway means communicating the outlet of said intake passageway with the internal combustion engine; and exhaust gas recirculating means for recirculating the exhaust gas from said internal combustion engine to the intake passageway, said exhaust gas recirculating means having an outlet opening disposed in a wall surface of said intake passageway between said air valve and said throttle valve such that the exhaust gas is fed into the air-fuel mixture downstream of said air valve and said fuel jet means.

2. A gas mixture feed system as set forth in claim 1, wherein said air valve is a movable vane operatively associated with the throttle valve.

3. A gas mixture feed system as set forth in claim 1, wherein said carburetor includes a Venturi in said intake passageway, and said air valve comprises a movable vane operatively associated with the throttle valve and has a front surface defining a portion of said Venturi and a rear surface, said fuel jet means being disposed in confronting relationship with the front surface of said movable vane, the outlet opening of said exhaust gas recirculating means being in confronting relationship with the rear surface of said movable vane.

4. A gas mixture feed system for an internal combustion engine wherein said gas mixture feed system comprises:

a carburetor including an intake passageway, a throttle valve provided in said intake passageway, a movable air valve in the intake passageway upstream of said throttle valve, and a fuel metering device connecting a fuel supply source to said intake passageway and controlled by said air valve;

intake passageway means communicating the outlet of said intake passageway of the carburetor with the internal combustion engine; and an exhaust gas recirculating device for recirculating the exhaust gas from said internal combustion engine to the intake passageway, said exhaust gas recirculating device having an outlet opening disposed in a wall surface of said intake passageway between said air valve and said throttle valve, wherein said air valve is a movable vane operatively associated with the throttle valve, the outlet opening of said exhaust gas recirculating device is at a portion of said wall surface of said intake passageway, said portion confronting the rear surface of said vane, and guide means is provided in the vicinity of the outlet opening of said exhaust gas recirculating device such that part of the exhaust gas recirculated is caused to impinge on said vane and another part of the exhaust gas recirculated is caused to flow along said wall surface around said outlet opening.

5. A gas mixture feed system as set forth in claim 3, wherein said exhaust gas recirculating means is provided thereon with a heat insulating material for preventing heat from being conducted to the main body of carburetor.

6. A gas mixture feed system as set forth in claim 3, wherein said exhaust gas recirculating means is provided with a control valve and means of varying the opening area of said control valve in accordance with the movement of said movable vane.

Figure 7:
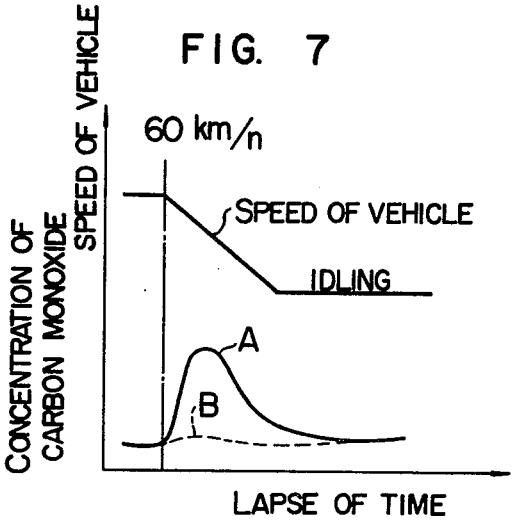
FIG. 7 is a graph showing the change of concentration of carbon monoxide in the exhaust gas with time during reduced speed operation of a vehicle.

7. A gas mixture feed system for an internal combustion engine wherein said gas mixture feed system comprises:

As has been described above, part of the exhaust gas fed from the outlet opening 22 to the intake passageway 9 is caused to flow along the wall surface 8*a* around the outlet opening under the guidance of the distributing member 23. Said flow prevents the fuel out of the nozzle 18 from being attached to the wall surface 8*a*. In the conventional carburetor, the fuel from the fuel nozzle has been attached to the wall surface confronting the nozzle, and at the time of reduced speed operation, the fuel attached to said wall surface has been vaporized to vary the air-fuel ratio of the gas mixture, thereby increasing the concentration of carbon monoxide in the exhaust gas temporarily as shown by a curve A in FIG. 7. In the present embodiment, however, the fuel is prevented from being attached to the wall surface and hence the variation of air-fuel ratio with time is decreased to a considerable extent, and the increase of carbon monoxide is controlled at the time of reduced speed operation as shown by a curve B in FIG. 7. With the conventional variable stage type carburetor, such a phenomenon or icing phenomenon has occurred that the vane 11, particularly, the portion in the vicinity of the mounting portion of the needle 20 is cooled to be frozen at the time of low temperature. In the present embodiment, however, icing phenomenon is prevented because the recirculated exhaust gas impinges on the vane 11.

Figure 8:
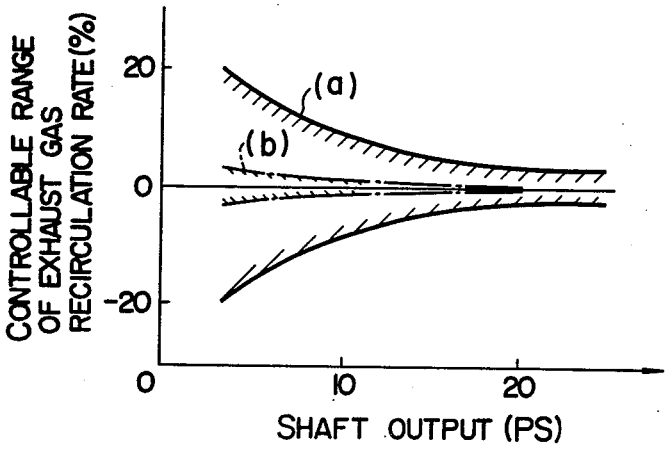
FIG. 8 is a graph showing the controllable range of the exhaust gas recirculation rate against the shaft output.

Next, description is given of the control of the exhaust gas recirculation rate. With the variable stage type carburetor shown in FIG. 7, the vane 11 is operationally associated with the throttle valve 10 to be opened or closed, the quantity of air intake is determined in accordance with the sectional area of the passageway between the vane 11 and the fixed Venturi wall 14 and the negative pressure at the portion downstream of the vane. On the other hand, the quantity of the exhaust gas recirculated is determined in accordance with the opening area of the control valve 7 and the negative pressure at the portion downstream of the vane. Consequently, if the opening area of the control valve 7 is made to be proportional to the sectional area of the passageway between the vane 11 and the fixed Venturi wall 14, then the recirculation rate can be maintained at a constant value. As described above, with the variable stage type carburetor, the vane 11 is operationally associated with the throttle valve 10, and the sectional area of the passageway between the vane 11 and the fixed Venturi wall 14 is substantially proportional to the opening degree of the throttle valve 10. Moreover, in the present embodiment, as shown in FIG. 5, the opening area of the control valve 7 is substantially proportional to the opening degree of the throttle valve between the opening degrees $V_1$ and $V_2$ of the throttle valve. For this, the exhaust gas recirculation rate is maintained at a constant value between the opening degrees $V_1$ and $V_2$ of the throttle valve. As described above, the plunger 24 of the control valve 7 is mechanically connected to the vane shaft 13 to be driven and hence the opening area of the control valve 7 is not influenced by the Venturi negative pressure, and is reliably proportional to the opening degree of the vane 11. For this, accuracy in controlling the exhaust gas recirculation rate is not decreased at the time of operating condition of low Venturi negative pressure, i.e., at low speed and low load unlike with the conventional control valve actuated by the negative pressure. FIG. 8 shows an example of the results of experiments where the controllable range of the recirculation rate by use of the control valve actuated by the conventional Venturi negative pressure is indicated by (*a*) and the controllable range of the recirculation rate according to the present embodiment is indicated by (*b*). As evident from FIG. 8, in the present embodiment the variation in controlling the exhaust gas recirculation rate at the time of low output operation is reduced to a considerable extent. Additionally, since the control valve 7 is not influenced by Venturi negative pressure, the exhaust gas recirculation rate can be maintained at a constant value even at the time of accelerated or decelerated operation where Venturi negative pressure is varied to a great extent.

The exhaust gas recirculation is not effected during idle running where the opening degree of the throttle valve being below $V_1$ and at the time of the full opening degree, because the control valve 7 is closed. Consequently, idling running and full throttle operation of the engine can be stably performed.

At the time of the exhaust gas recirculation, it is necessary to decrease the air-fuel ratio of the gas mixture in the carburetor by about 1 to enrich the gas mixture, thereby improving the stability of combustion. In the present embodiment, this is achieved by use of the regulating valve 32. More specifically at the time when the control valve 7 begins to open (when the opening degree of the throttle valve 10 is $V_1$), the air bleed regulating valve 32 is energized to close the air bleeder 19 to thereby increase the quantity of fuel supply. At the time when the throttle valve 10 is fully open, the air bleed regulating valve 32 is deenergized and the control valve 7 is closed to open the air bleeder 19, to thereby decrease the quantity of fuel supply.

As the exhaust gas is recirculated to the intake passageway 9, it passes through the intake passageway 21 formed in the main body 8 of carburetor. However, the heat insulating material 36 is mounted on the intake passageway and hence such a problem can be avoided that the main body 8 of carburetor is unduly highly heated to cause troubles such as percolation.

In the embodiment described above, the exhaust gas recirculation rate is maintained at a constant value between the opening degrees $V_1$ and $V_2$ of the throttle valve. However, there is such a case that it is desirable to change the exhaust gas recirculation rate in accordance with the opening degree of the throttle valve. In that case, it is possible to change the exhaust gas recirculation rate in accordance with the opening degree of the throttle valve by changing the contour of cross-section of the throughhole 25 of the plunger 24 or the configuration of the cam 27.

FIG. 9 shows a version of an embodiment of the control valve for controlling the exhaust gas recirculated. In the drawing, formed in the main body of carburetor is a chamber 37 which is divided into two chambers 37*a*, 37*b* by a diaphragm 38. Mounted at the central portion of the diaphragm 38 is a valve body 39 having tapered surfaces 39*a*, 39*b* at opposite sides thereof. Valve seats 40 and 41 are formed in opposite relationship to the tapered surfaces 39*a*, 39*b*, respectively. One chamber 37*a* of said chambers is communicated with a passageway 42 connected to the exhaust gas recirculating pipe, and further, communicated with a passageway 43 through a passageway formed between the valve seat 40 and the tapered surface 39*a*. The passageway 43 has an opening between the movable vane of the intake passageway of carburetor and the throttle valve. On the other hand, the other chamber 37*b* is maintained in a carburetor including an intake passageway, a throttle valve provided in said intake passageway, a movable air valve in the intake passageway upstream of said throttle valve, and a fuel metering device connecting a fuel supply source to said intake passageway and controlled by said air valve;

intake passageway means communicating the outlet of said intake passageway of the carburetor with the internal combustion engine; and an exhaust gas recirculating device for recirculating the exhaust gas from said internal combustion engine to the intake passageway, said exhaust gas recirculating device having an outlet opening disposed in a wall surface of said intake passageway between said air valve and said throttle valve, wherein said air valve is a movable vane operatively associated with the throttle valve, the outlet opening of said exhaust gas recirculating device is at a portion of said wall surface of said intake passageway, said portion confronting the rear surface of said vane, and said exhaust gas recirculating means comprises:

an exhaust gas passageway formed in the main body of the carburetor;

a plunger movable so as to transverse said exhaust gas passageway and formed therein with a through-hole; and means for operatively connecting said plunger to said movable vane such that said plunger is movable in accordance with the movement of said movable vane so as to vary the opening area defined by said exhaust gas passageway and said through-hole.

8. A gas mixture feed system as set forth in claim 6, wherein said control valve is fully closed at the time when said throttle valve is positioned below a predetermined first opening degree in the vicinity of opening degree of idle running and at the time when said throttle valve is fully open.

9. A gas mixture feed system as set forth in claim 8, wherein the opening area of said control valve is proportional to the opening area between said movable vane and said intake passageway at the time when said throttle valve is positioned between said first opening degree and a second opening degree in the vicinity of full opening.

10. A gas mixture feed system for an internal combustion engine wherein said gas mixture feed system comprises:

a carburetor including an intake passageway, a throttle valve provided in said intake passageway, a movable air valve in the intake passageway upstream of said throttle valve, and a fuel metering device connecting a fuel supply source to said intake passageway and controlled by said air valve;

intake passageway means communicating the outlet of said intake passageway of the carburetor with the internal combustion engine; and an exhaust gas recirculating device for recirculating the exhaust gas from said internal combustion engine to the intake passageway, said exhaust gas recirculating device having an outlet opening disposed in a wall surface of said intake passageway between said air valve and said throttle valve, wherein said air valve is a movable vane operatively associated with the throttle valve, the outlet opening of said exhaust gas recirculating device is at a portion of said wall surface of said intake passageway, said portion confronting the rear surface of said vane, and said exhaust gas recirculating means is provided with a control valve and means for varying the opening of said control valve in accordance with the movement of said movable vane;

and further wherein the fuel metering means of said carburetor further comprises:

an air bleeder;

a regulating valve for opening and closing said air bleeder; and means for controlling said regulating valve so as to open said air bleeder at the time when said control valve of the exhaust gas recirculating means is closed.

11. A gas mixture feed system for an internal combustion engine wherein said gas mixture feed system comprises:

a carburetor including an intake passageway, a throttle valve provided in said intake passageway, a movable air valve in the intake passageway upstream of said throttle valve, and a full metering device connecting a fuel supply source to said intake passageway and controlled by said air valve;

intake passageway means communicating the outlet of said intake passageway of the carburetor with the internal combustion engine; and an exhaust gas recirculating device for recirculating the exhaust gas from said internal combustion engine to the intake passageway, said exhaust gas recirculating device having an outlet opening disposed in a wall surface of said intake passagewy between said air valve and said throttle valve, wherein said air valve is a movable vane operatively associated with the throttle valve, the outlet opening of said exhaust gas recirculating device is at portion of said wall surface of said intake passageway, said portion confronting the rear surface of said vane, and said exhaust gas recirculating means is provided with a control valve and means for varying the opening of said control valve in accordance with the movement of said movable vane;

and further comprising air feed means for feeding air to the portion of said intake passageway between said movable vane and the throttle valve, said air feed means including an air control valve operatively connected to said control valve such that the opening area of the air control valve is decreased with the increase of the opening area of said control valve for the recirculated exhaust gas.

* * * * *